US012006009B2

(12) United States Patent
Schricker

(10) Patent No.: US 12,006,009 B2
(45) Date of Patent: Jun. 11, 2024

(54) ADAPTABLE LANDING GEAR ASSEMBLY

(71) Applicant: Wilder Side LLC, Peoria, IL (US)

(72) Inventor: David Richard Schricker, Peoria, IL (US)

(73) Assignee: WILDER SIDE LLC, Peoria, IL (US)

( * ) Notice: Subject to any disclaimer, the term of this patent is extended or adjusted under 35 U.S.C. 154(b) by 414 days.

(21) Appl. No.: 17/645,106

(22) Filed: Dec. 20, 2021

(65) Prior Publication Data

US 2023/0192252 A1 Jun. 22, 2023

(51) Int. Cl.
*B63C 13/00* (2006.01)

(52) U.S. Cl.
CPC ..... *B63C 13/00* (2013.01)

(58) Field of Classification Search
CPC ..... B63B 13/00
See application file for complete search history.

(56) References Cited

U.S. PATENT DOCUMENTS 4,706,983 A * 11/1987 Griswold ..... B63C 13/00 D34/28
6,189,478 B1 * 2/2001 Myers ..... B63C 13/00 114/344
6,824,155 B1 * 11/2004 Heck ..... B63C 13/00 114/344
11,027,803 B1 6/2021 Brinkley

* cited by examiner

*Primary Examiner* — Stephen P Avila
(74) *Attorney, Agent, or Firm* — Westman, Champlin & Koehler, P.A.

(57) ABSTRACT

An adaptable landing gear assembly for small watercraft such as kayaks and canoes is described supporting transport of such watercraft from a point on land to a body of water. The assembly includes a cross member to secure the assembly to the watercraft, a pair of positioning brackets, and a pair of wheeled leg assemblies that can rotate between a vertical position to transport watercraft on land and a horizontal position to enable unfettered use of watercraft while floating on water. A position holding pin engages with retaining slots in said position brackets to enable fixed positions of the wheeled leg assemblies with respect to the cross member. A convenient release lever enables operator to release the position holding pin and rotate leg assembly from a first position to a second position.

23 Claims, 11 Drawing Sheets

85

ADAPTABLE LANDING GEAR ASSEMBLY

BACKGROUND OF THE INVENTION

Field

This present disclosure relates generally to watercrafts and, more particularly, to a multi-positional adaptable wheeled device and assembly that purposes to solve one or more problems that persons who use kayaks and canoes (hereafter referred to as watercraft) face when they are dealing with transporting the watercraft between land and a body of water.

Related Art

One common means of conveyance that is generally available on the marketplace are wheeled carts designed for small watercraft. These devices typically have two wheels attached to a shallow vee structure above the wheels to cradle a small section of the hull of the small watercraft. Often, a strap is used to prevent movement between the cradle and the hull during use. To use this apparatus, the user must unload the craft from their vehicle, place it on the ground, place the wheels on the ground, then lift one end of the watercraft onto the wheeled cart, balance both entities while then securing the strap. Upon reaching the water, the user either removes the cart prior to entering the water, typically reversing the steps used to load the watercraft on said cart. Another approach is to enter the water with the wheeled cart and then remove the strap while the wheels are under the watercraft in the water. Once the wheels are removed, then the user must decide to either stow the wheels inside the watercraft or leave them on land either on the dock or back at their vehicle. In either case, the user typically also must step into the body of water to either drag their craft into the water or remove the dolly strapped to the watercraft. If using a public boat ramp, this extra time and hassle is stressful especially if other boaters are waiting to use the ramp as well.

Another style of watercraft is a sit-on-top kayak with scupper holes to allow water captured in the passenger area to drain back into the body of water. In this instance, the scupper holes can serve a dual purpose to secure rods attached to a two-wheel apparatus to enable easy transport to the water. When using this device, the kayak is unloaded from the vehicle on the ground, turned on its side wherein the wheeled apparatus is "plugged into" the scupper holes, and then can be easily wheeled down to the water. However, this device typically must be removed prior to entering the water for easy removal. All gear from the kayak is removed, the kayak turned on its side, the wheel device detached, boat back on the hull, drag the craft into the water, then go back and get your gear and fit out your kayak for your day of fishing.

What is needed by many users of small watercraft is a landing gear assembly that:

1. remains structurally connected during use, meaning no parts can fall off the assembly during use,
2. withstands repeated encounters of jarring bumps and uneven terrain while on land without structural failure of the assembly or the watercraft,
3. is designed and configured with materials that make the overall assembly both light weight and structurally rigid and sound,
4. is configured so the landing gear bears the majority of the weight of the watercraft and associated gear, 5. can be manipulated with one hand to reposition the wheeled legs while comfortably sitting at the operator station of the watercraft,
6. enables the watercraft to be loaded up with gear such as that used for fishing at the load out location such as near a pickup truck and remain upright until the use of the watercraft is complete, and
7. enables the user to walk the watercraft and associated gear from the load out location to the body of water while also maintaining the watercraft in an upright orientation throughout the transport, launching, and initial maneuvering phases in the body of water, and offers similar convenience when reversing the steps to get the watercraft from the body of water back to the load out location.

The author of this disclosure believes that the adaptable landing gear assembly described herein contains new and useful inventions that fulfill in large part the seven requirements of a highly functional system as just described.

SUMMARY OF THE INVENTION

In accordance with the present inventions, an adaptable wheel assembly is provided for manipulating a watercraft. These inventions provide an improved unit that is structurally sound, stays mechanically connected to itself and the watercraft during use, has substantial weight bearing capacity, and can be configured to reduce torsional loads produced by wheeled legs supporting the weight of the watercraft. The improved unit provides for an intuitive and ergonomic means to move the wheeled legs from a vertical or deployed position to a substantially horizontal or stowed position. In addition, the improved unit enables the watercraft to remain upright with belongings kept in place once initially unloaded from a land vehicle such as a pickup truck, through the launching process into the water, and back out again onto land and to the final load-out phase back at said land vehicle.

In one embodiment, a retractable wheel assembly that supports and transports a watercraft includes a cross member, a wheel, an axle, a wheel leg perpendicular to the axle, a positioning bracket that contains one or more retaining slots, a position holding pin that engages with said retaining slots, a lever release mechanism, a spring attached at one end to the lever release mechanism and the other to a wheel leg, and a leg pivot pin that enables the wheel leg to rotate between a substantially vertical position and a horizontal position.

In particular examples, the retractable wheel assembly is attached to a canoe. The cross member is secured to the top of the canoe by a gunnel clamp. The gunnel is captured between the gunnel clamp and the cross member via the gunnel clamp tightened with a bolt and a hand wheel. A pair of offset spacers may be attached to the cross member to additionally constrain the relative position of the retractable wheel assembly to that of the canoe.

In certain examples, the retractable wheel assembly includes a fixed mount assembly and two wheeled leg assemblies. The fixed assembly includes two positioning brackets bolted securely to a cross member. The wheeled leg assemblies include an elongated leg, an axle, a wheel, and a release lever subassembly that includes a spring. The positioning brackets include two position retaining slots and a top sliding surface. The release lever subassembly includes a position holding pin and a release lever. When a position holding pin slides into a retaining slot, the action of the spring and shape of the retaining slot result in the position holding pin remaining in the slot. The limited motion of the position holding pin acts on various members of the leg assembly to secure it into a desired position relative to the side of the watercraft. Only by pressing the release lever will the position holding pin clear the retaining slot and be able to move along the top sliding surface to encounter a different retaining slot and thereby move the wheeled leg assembly from a deployed to a stowed position or visa versa.

In particular examples, the adaptable landing gear assembly can be configured to maintain more than two positions, depending on the number of retaining slots built into each positioning bracket. Some users have expressed an interest in legs protruding back at a 45-degree angle when unloading a kayak from a pickup, for instance. Such adaptations of said assembly are withing the framework of the inventions disclosed herein and appended claims.

In certain examples, various brackets can be fashioned to attach to the rear of the positioning bracket to securely mount the rear portion of the positioning bracket to a second location on the top surface of the watercraft. These additional mounting points may be either bolted or pinned to the rear of the craft, depending on whether the user wants the system to be permanently mounted on the craft or optionally removed each time for transport. One benefit of the sturdy positioning bracket is to transmit torsional loads created by the wheeled leg assembly when it may encounter an obstacle such as a rock. Such encounters can magnify the torque load at the front attachment point because the leg acts like a lever arm to amplify the torque induced on the cross member. By installing a second bracket at the rear of the positioning bracket that further constrains the rotation of the cross member relative to the watercraft, the integrity of the watercraft attachment points can be maintained. Other systems have a relatively narrow distance between a front and rear attachment point and require substantial bracing, for instance, inside the hull of a kayak. By increasing the distance between the front and rear attachment points, the retractable wheel assembly design described herein results in less force required at each mounting location to resist the bending moment generated at the end of the wheeled leg and can reduce the chances of hull damage from forces induced onto the landing gear assembly that are then transferred to the watercraft.

In particular examples, the retractable wheeled leg assemblies when stowed are not parallel to one another. This may be advantageous when the rear of the watercraft tapers to a point such as is commonly observed in canoes and some kayaks. One benefit of the adaptable wheel assembly is to enable a positioning bracket to be positioned at a desired angle onto the cross member such that the wheeled leg assembly in the stowed position can be substantially parallel to the adjacent gunnel of the watercraft when looking at the watercraft and landing gear assembly from a plan or top view. This not only reduces the chances of damage to the wheeled leg but also can improve the appearance of the assembly integrated with the watercraft.

A usage example pointing to some of the benefits of the disclosed retractable wheeled assembly will be discussed. This particular example will be of a kayak loaded in a pickup truck bed with user wanting to unload the kayak and transport the kayak to a lake. The user has already installed the adaptable landing gear assembly on the kayak and the legs are in the stowed or horizontal position. The user could perform the following steps to move the kayak from the truck bed to a body of water:

1) The user can pull the kayak partially out of the bed if necessary to access the retractable landing gear assembly. At this point, pressing the release lever towards the wheel post handle releases the position holding pin and allows the wheeled leg to rotate into the deployed position. A similar process is then followed on the other side to result in both sides in deployed position.

2) The user can grab the stern of the kayak and pull until just a few feet of bow rests on the truck edge and the rear weight can rest on the wheels of the deployed landing gear assembly.

3) Then the user gingerly moves the bow off the tail of the truck bed and places it on grass or a protective surface. At this point any additional gear can be loaded onto the kayak up the weight limit of the landing gear.

4) The user can now grab the bow of the watercraft and walk it to the water's edge, guide the system into the water, and step onto the watercraft. Once the user is seated, it is very convenient to simply press the back of the release levers and the wheel post assemblies can rotate back and out of the water for stowing while in use on the water.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF DRAWINGS

Embodiments of the disclosure will be better understood by reading of the Detailed Description of the Invention along with a review of the drawings, in which.

DETAILED DESCRIPTION OF THE INVENTION

Figure 1:
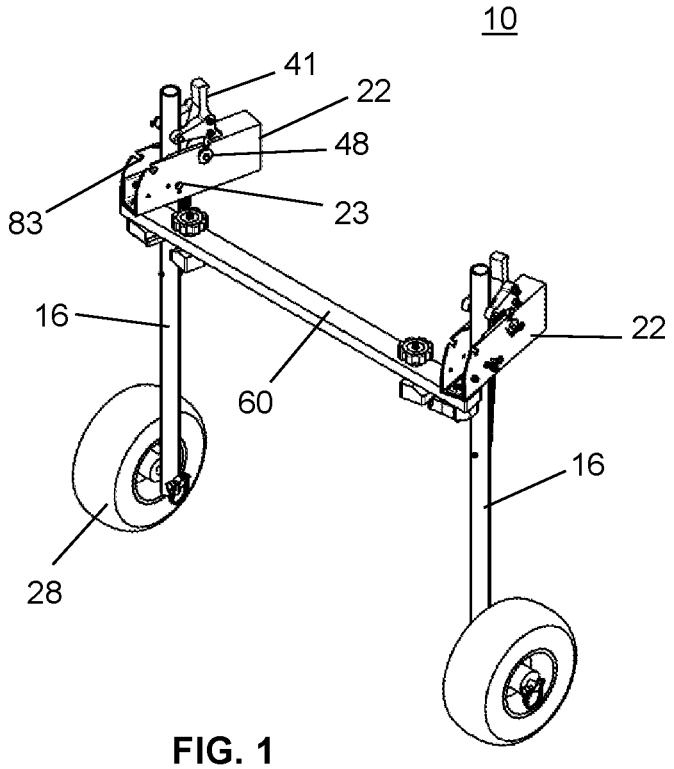
FIG. 1 is a perspective front view of a wheel assembly according to one embodiment of the disclosure.
Figure 1A:
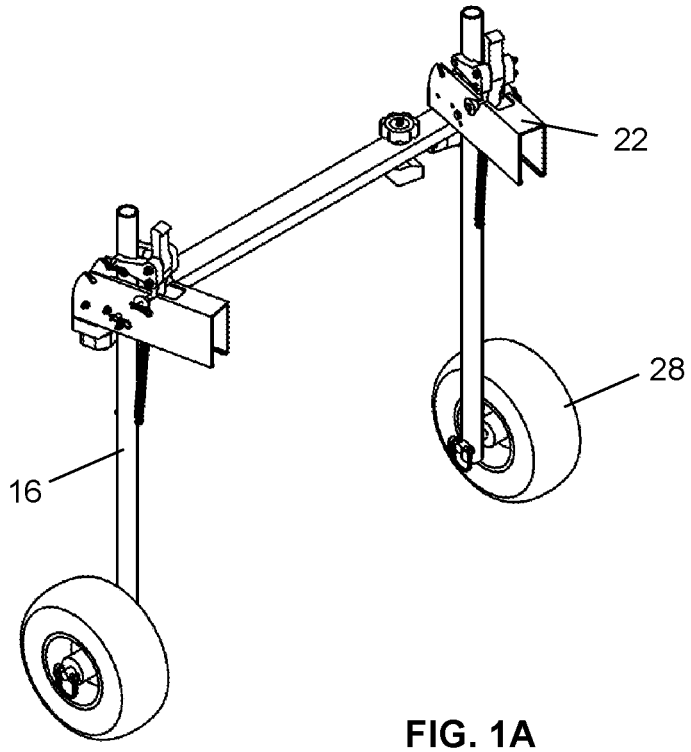
FIG. 1A is a perspective rear view of the wheel assembly embodiment of FIG. 1.
Figure 1B:
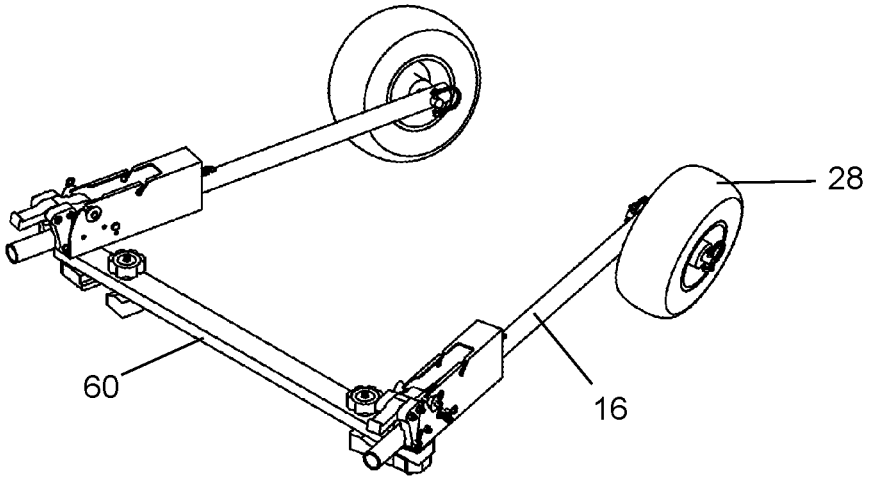
FIG. 1B is a perspective front view of the wheel assembly embodiment of FIG. 1 in a second position.
Figure 1C:
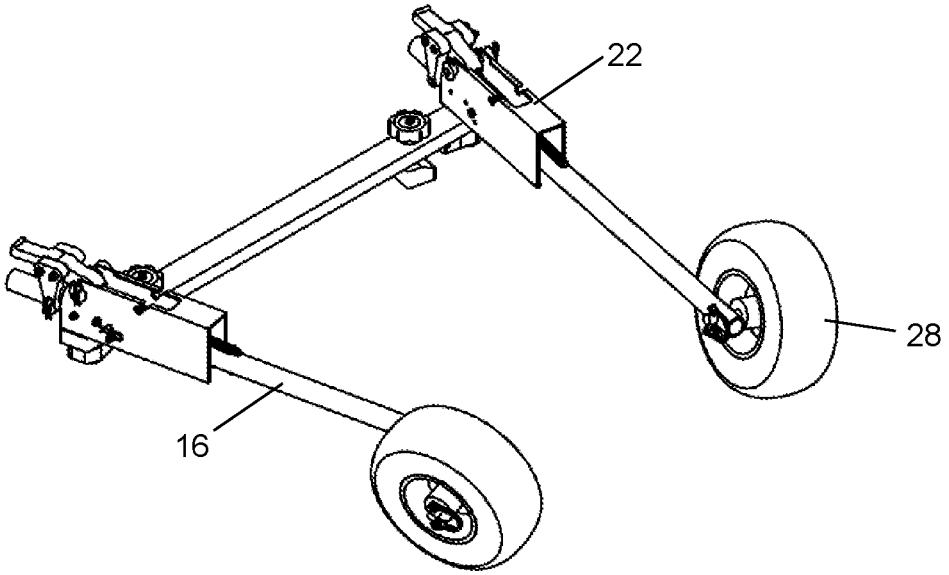
FIG. 1C is a perspective rear view of the wheel assembly embodiment of FIG. 1 in a second position.
Figure 1D:
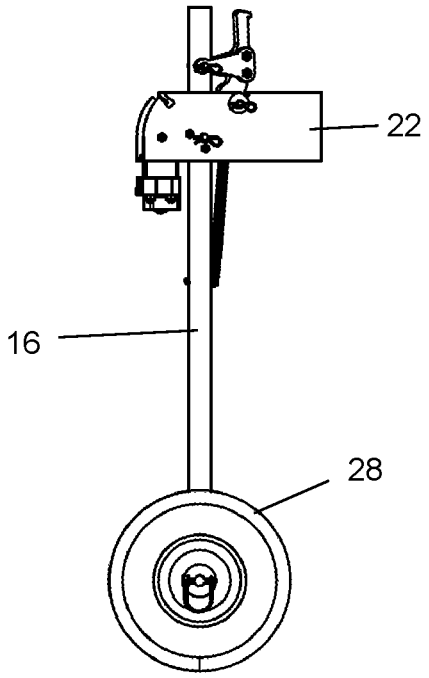
FIG. 1D is a side view of the wheel assembly embodiment of FIG. 1.
Figure 1E:
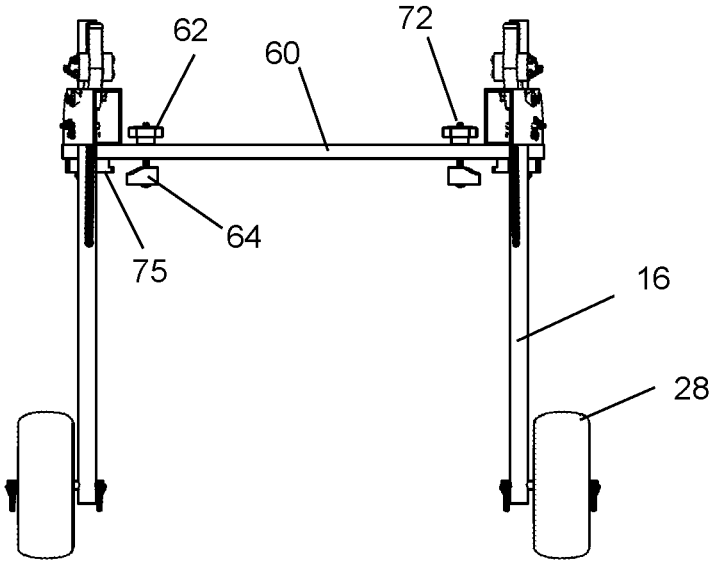
FIG. 1E is a rear view of the wheel assembly embodiment of FIG. 1.
Figure 1F:
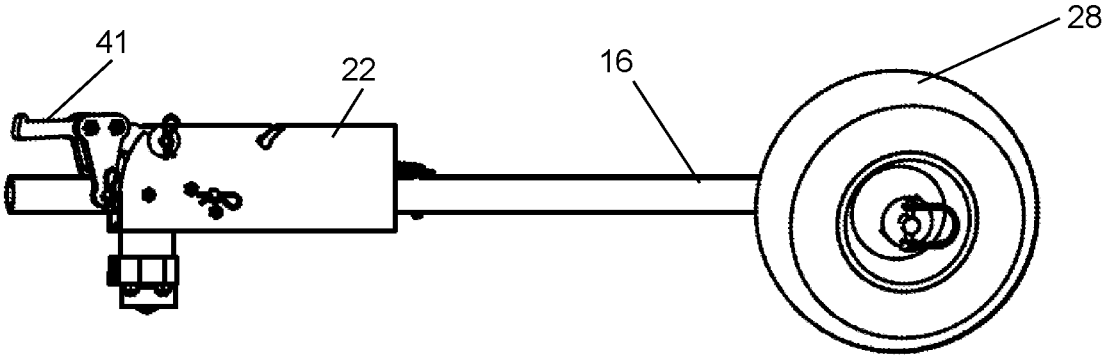
FIG. 1F is a side view of the wheel assembly embodiment of FIG. 1 in a second position.
Figure 1G:
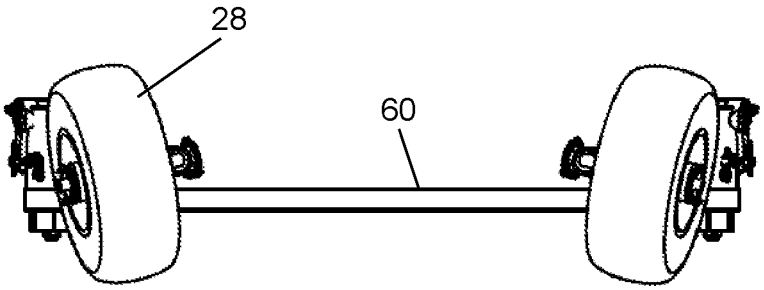
FIG. 1G is a rear view of the wheel assembly embodiment of FIG. 1 in a second position.

Referring to the drawings in general and to FIG. 1 in particular, it will be understood that the illustrations are for the purpose of describing embodiments of the disclosure and are not intended to limit the disclosure or any inventions thereto. As seen in FIG. 1, the adaptable wheel assembly 10 includes at least one wheeled leg assembly 16 connectable to and disconnectable to a positioning bracket 22. Each positioning bracket is attached to a cross member 60 which is then attached via various means to a particular watercraft for upright transport along a surface, including, but not limited to a road, parking lot, beach, ramp, shallow lakes and ponds, and the like. FIG. 1 introduces an assembly having two wheeled leg assemblies 16, each with a corresponding positioning bracket 22, however other embodiments may include a single and more than two associated wheel leg assemblies and positioning brackets. Further, as shown and described herein, any watercraft may include a canoe, kayak, boat, other water vehicle, and alternative embodiments including semi land vehicles.

Adaptable wheel assembly 10 may be positioned, relative to the watercraft on which it is mounted, in any variety of extended and retracted positions to match the desired application. In the illustrated embodiment of FIG. 1, a positioning bracket 22 allows for two secured positions of a wheeled leg assembly 16, one in which the wheeled leg assembly is generally in a vertical position for transport on land and during the watercraft launching process into and out of a body of water, and the other in a generally horizontal position when the watercraft is floating and traveling on a body of water. FIGS. 1, 1A, 1D, and 1E show various views of the wheeled leg assembly in an extended position where the wheels 28 are below the positioning bracket and ready to bear the weight of the watercraft on land and during launch. FIGS. 1B, 1C, 1F, and 1G show various views of the wheeled leg assembly in a generally horizontal or retracted position where the wheels 28 are behind the positioning brackets 22 and raised to not interfere with use of the watercraft while it is either floating on a body of water or sitting on a surface of a land vehicle such as a pickup bed. Throughout the disclosure, using the terms extended or vertical or deployed shall be used interchangeably to indicate a first position of said wheeled leg assembly and conversely using the term horizontal or retracted or stowed shall be used interchangeably indicating a second position of said wheeled leg assembly.

Figure 2:
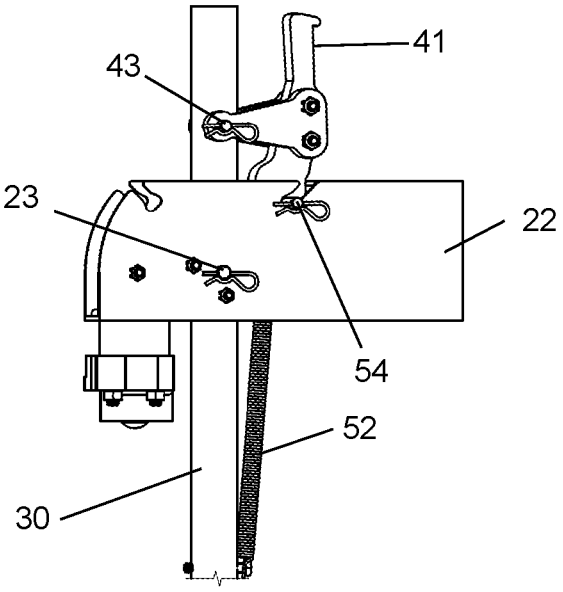
FIG. 2 is a side view of isolated wheel assembly elements of the embodiment introduced in FIG. 1 with certain elements removed for clarity.
Figure 2A:
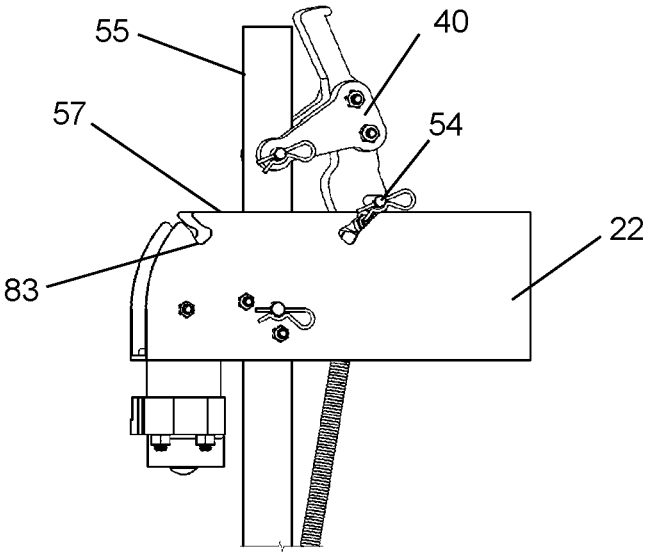
FIG. 2A is a side view of isolated wheel assembly elements of the embodiment introduced in FIG. 1 with some elements in a second position to illustrate functionality.

FIG. 2 introduces an isolated view of the embodiment of FIG. 1 and highlights portions of the assembly that interact to secure the leg 30 in a vertical or deployed position. The action of the spring 52 pulling on the release lever subassembly 40 causes the position holding pin 54 to remain in a particular retaining slot 83. FIG. 2A shows another view of the components in FIG. 2 in a different orientation after an operator applies sufficient force to the release lever 41. Referring now to FIGS. 1, 2, and 2A, in order to reposition the wheeled leg assembly 16, the operator moves the release lever 41 towards the non-wheeled end of the leg 30, thereby causing the release lever subassembly 40 to rotate about the lever pivot pin 43, thereby causing the position holding pin 54 to disengage from a retaining slot 83 manufactured into the positioning bracket 22, as illustrated in FIG. 2A. In this new state, the wheeled leg assembly 16 is free to rotate about the leg assembly pivot pin 23 between a first and second position. As the wheeled leg assembly 16 begins to rotate, the operator removes pressure on the release lever 41 so that the position holding pin 54 is free to slide along an upper sliding surface 57 of the positioning bracket 22. The operator continues the motion of the leg assembly by applying force to the non-wheeled end of the wheeled leg assembly 16 in the area identified as the handle end 55. As the wheeled leg assembly 16 reaches a desired position, the position holding pin 54 encounters an aligned pair of retaining slots 83 and will slide into and remain in the retaining slots by the force of the spring 52, thereby locking the wheeled leg assembly 16 into the desired position. The repositioning process is repeated for all other wheeled leg assemblies in a given configuration. In the embodiment illustrated in FIG. 1, the positioning process described herein would be completed twice, once for each wheeled leg assembly 16.

Figure 2B:
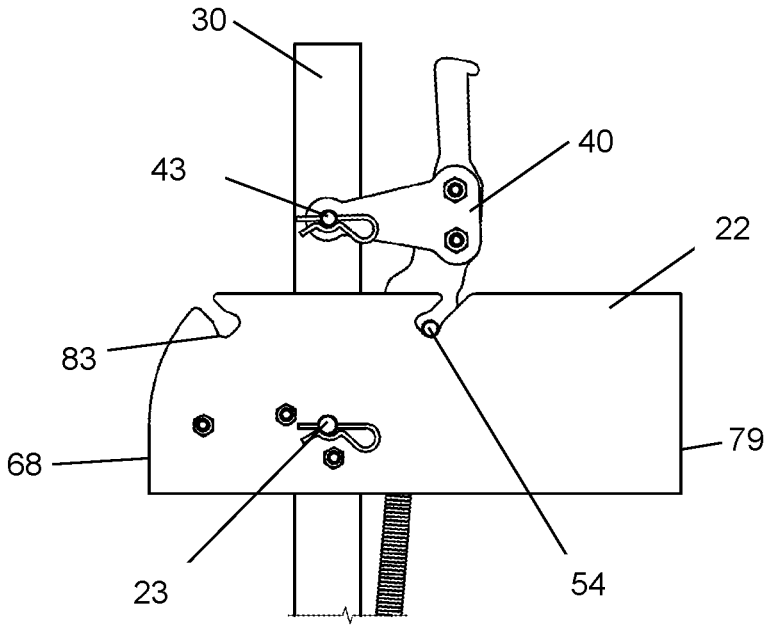
FIG. 2B is a side view of isolated wheel assembly elements of the embodiment introduced in FIG. 1 with certain elements removed for clarity with some elements in a first position.
Figure 2C:
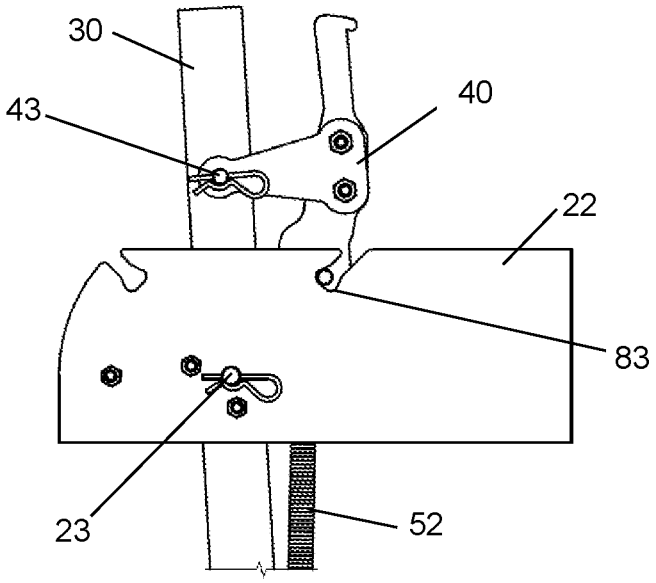
FIG. 2C is a side view of isolated wheel assembly elements of the embodiment introduced in FIG. 1 with certain elements removed for clarity with some elements in a second position.

The ability of adaptable wheel assembly 10 to maintain fixed orientations of wheeled leg assemblies 16 with respect to a watercraft will be further discussed. FIGS. 2B and 2C are isolated side views of key portions of the position locking mechanism with other components of the embodiment removed for clarity. In said views, the positioning bracket 22 is oriented so that the forward edge 68 is towards the left of the page, and the rear edge 79 is nearer the right of the page. The figures illustrate how the leg 30 can be held in a generally vertical position by forces exerted by the leg assembly pivot pin 23 and the lever pivot pin 43. Firstly, the leg assembly pivot pin 23 constrains said leg to rotation about said pivot pin. Note that lateral movement of the leg 30 along the axis of the leg assembly pivot pin 23 is constrained by the sides of a positioning bracket 22 as can be seen in FIG. 1. Secondly, the position holding pin 54 constrains the motion of the release lever subassembly 40 via interaction of said pin with the bottom edges of the retaining slot 83 and the other members of the release lever subassembly 40. FIG. 2B shows the position holding pin 54 in the rearward retaining slot 83 and seated on a right lower edge of said slot. FIG. 2C shows the position holding pin 54 in the rearward retaining slot 83 and seated on left lower edge of said slot. Reaction forces between the retaining slot 83 and position holding pin 54 transfer to the release lever subassembly 40 which in turn transfer to the lever pivot pin 43 to constrain the leg 30 to a generally vertical orientation as shown in FIGS. 2B and 2C. The shape of a retaining slot 83 is such that said retaining slot is wider at the bottom where it is nearer the assembly pivot pin 23, and narrower as it approaches the top of the retaining slot further away from said pivot pin. Due to the geometry of the retaining slot 83 and position holding pin 54 as well as their orientation and connection within the entire assembly, the leg can only rotate a few degrees between the locations indicated in FIGS. 2B and 2C unless the release lever 41 is actuated as described in other parts of this disclosure. Similar motion restraint is induced on the leg 30 when the position holding pin 54 is located in the forward retaining slot 83 which would in turn restrain said leg in a retracted position.

Figure 3:
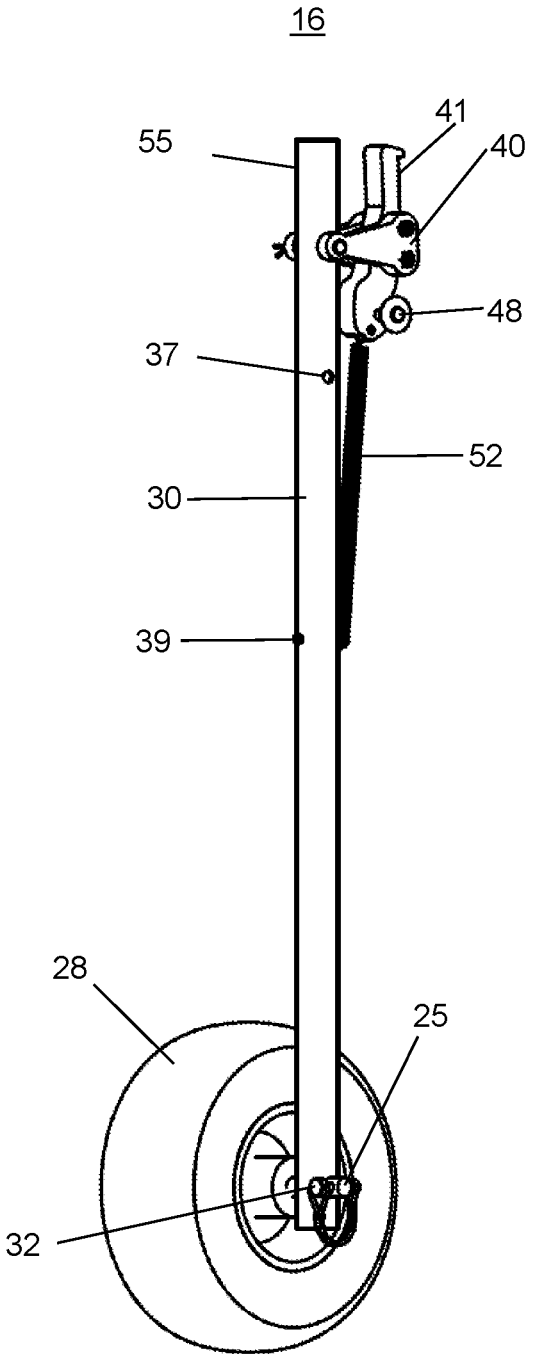
FIG. 3 is a view from a side perspective of isolated wheel assembly elements of the embodiment introduced in FIG. 1 with certain elements removed for clarity.

FIG. 3 introduces one embodiment of a wheeled leg assembly 16 which may include a wheel 28; an axle 25; a wire lock clevis pin 32; a leg 30; spring lower mounting hardware 39; a pivot pin cross hole 37; a handle end 55 on the leg 30; and a release lever subassembly 40 which may include a release lever 41, a position holding pin assembly 48, and a spring 52.

Figure 5:
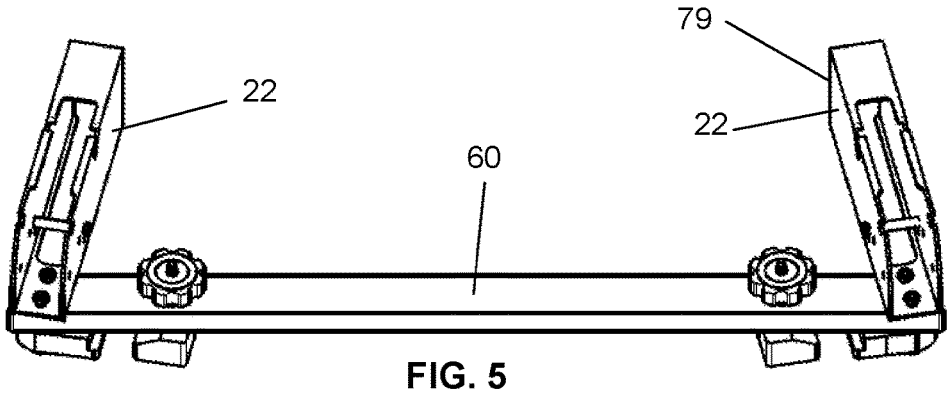
FIG. 5 is a perspective view of isolated wheel assembly elements of the embodiment introduced in FIG. 1 with elements removed for clarity.

FIG. 5 is an isolated view of components of embodiment of FIG. 1 which represents a fixed mount assembly 85 which includes a cross member 60 and two positioning brackets 22.

Referring now to FIGS. 1, 3, and 5, the embodiment of a landing gear assembly according to FIG. 1 comprises a fixed mount assembly 85 connected to two wheeled leg assemblies 16. In order to install the wheeled leg assemblies 16 to the fixed mount assembly 85, first the leg assembly pivot pins 23 are removed from said fixed mount assembly. Next, an axle 25 and a wheel 28 are removed from each leg assembly 16. This is accomplished by removing one wire lock clevis pin 32 from a corresponding axle 25 and sliding the axle 25 out of the leg 30. Now a wheeled end of the leg 30 without the wheel installed can be inserted into a top end of positioning bracket 22, oriented so that the release lever 41 is oriented generally towards the rear edge 79 of a positioning bracket 22. To ease assembly, the position holding pin 54 is aligned so that it slides to the bottom of the forward retaining slot 83. Next, the wheeled end of leg assembly 16 is adjusted so that the leg assembly pivot pin 23 can be inserted into corresponding holes in both the positioning bracket 22 and pivot pin cross holes 37 on the leg 30 and held in place by a cotter pin 24. Once this is accomplished, the user can reinsert an axle 25 and a wheel 28 into the leg 30 and secure the wheel with a wire lock clevis pin 32.

Figure 5A:
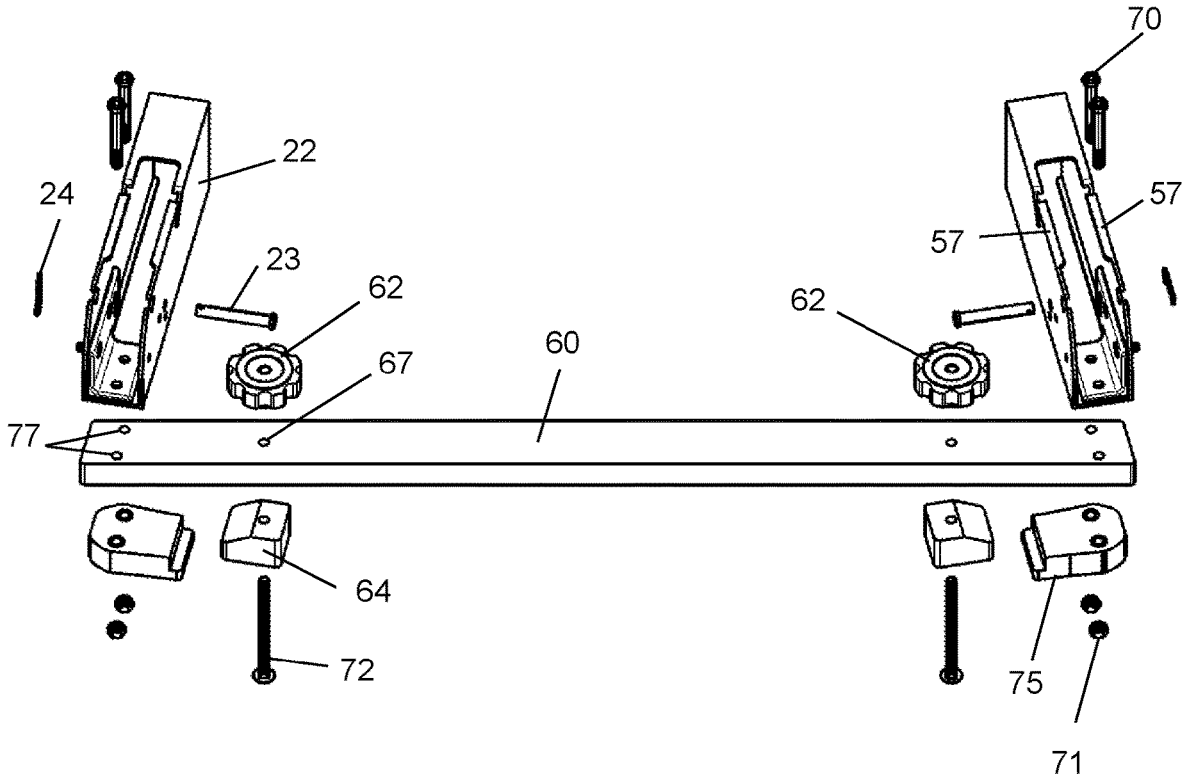
FIG. 5A is an exploded perspective view of isolated wheel assembly elements of the embodiment introduced in FIG. 1 with elements removed for clarity.

FIGS. 5 and 5A introduce the elements of a fixed mount assembly 85 according to one embodiment of the invention. The assembly process for the fixed mount assembly 85 consists of bracket bolts 70 sliding through mounting holes towards the front of a restraint bracket 22, then through mounting holes 77 on the cross member 60, then through mounting holes in an offset spacer 75, and secured in place with bracket nuts 71. The leg assembly pivot pin 23 is inserted in a pivot hole in positioning bracket 22 and secured in place with a cotter pin 24. The hand wheels 62, mounting bolts 72, and gunwale clamps 64 should be put in an accessory bag until ready to mount onto a watercraft.

Figure 4:
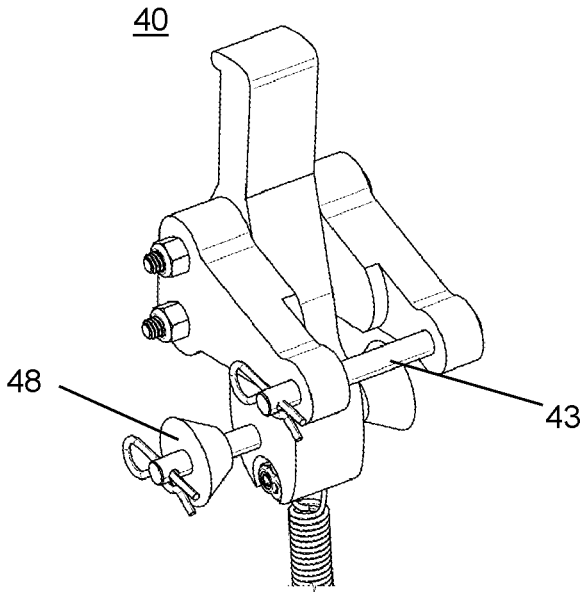
FIG. 4 is a perspective view of isolated wheel assembly elements of the embodiment introduced in FIG. 1 with elements removed for clarity.
Figure 4A:
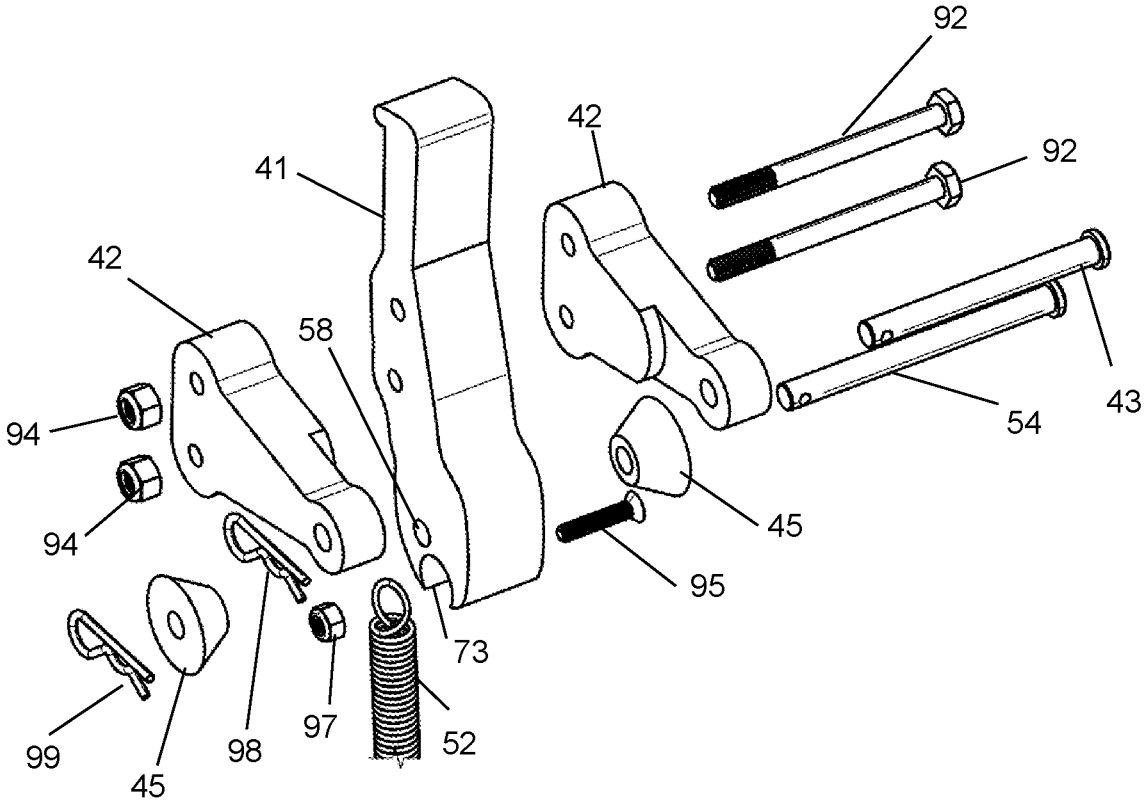
FIG. 4A is an exploded perspective view of isolated wheel assembly elements introduced in FIG. 1 with elements removed for clarity.

Referring now to FIGS. 4 and 4A, during initial installation the user may need to assemble one or more release lever subassemblies 40. The assembly process begins by inserting one release lever assembly bolt 92 into the fat end of a release lever side arm 42 as illustrated in FIG. 4A. A second release lever assembly bolt 92 is inserted into another hole in said release lever side arm 42 adjacent to the first. Next, the release lever 41 is inserted onto the projecting threads of the two aforementioned bolts, followed by a second release lever side arm 42, ensuring that the notched face of the narrow ends of the side arms face each other. Next, the release lever assembly nuts 94 are tightened onto the release lever bolts 92. Next, the position holding pin assembly 48 is installed by first inserting a position holding pin 54 into one tapered positioning spacer 45, then through a pin holding hole 58 in the release lever 41, next through another tapered positioning spacer 45, and the assembly is secured by installing a cotter pin 99 on the end of said position holding pin 54. The upper spring mounting screw 95 is pressed into a mounting hole that is opposite a spring relief cavity 73 machined into the release lever 41. One loop end of the spring 52 is inserted into the spring relief cavity 73 and over said spring mounting screw 95 and then the spring upper mounting nut 97 secures the said spring loop end in place. Now the release lever subassembly 40 is complete for one leg.

Referring now to FIGS. 3 and 4, a buildup of a complete wheeled leg assembly 16 may be needed at initial installation. This begins by taking a completed release lever subassembly 40 and installing it onto a leg 30, beginning by inserting a lever pivot pin 43 through one hole in the narrow end of a release lever side arm 42, through an upper mounting hole in the leg 30, and through another aligned hole in the second release lever side arm 42. The lever pivot pin 43 is secured to the leg 30 by installing a cotter pin 98. Next the lower end of a spring 52 is secured to the leg 30 by means of a bolt included in the spring lower mounting hardware 39 passing through a hole near the center of the leg 30 and secured in place by associated nut. Finally, an axle 25 is inserted into a corresponding mounting hole on leg 30 and then wheel 28 is held onto said axle by installing the wire lock clevis pin 32.

Figure 6:
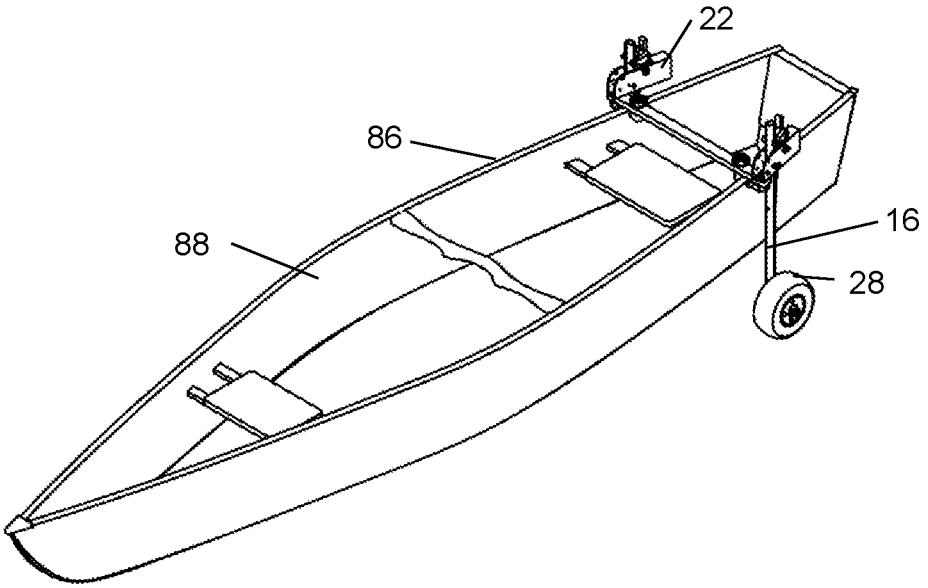
FIG. 6 is a perspective view of the wheel assembly embodiment of FIG. 1 installed on a watercraft in a deployed position.
Figure 6A:
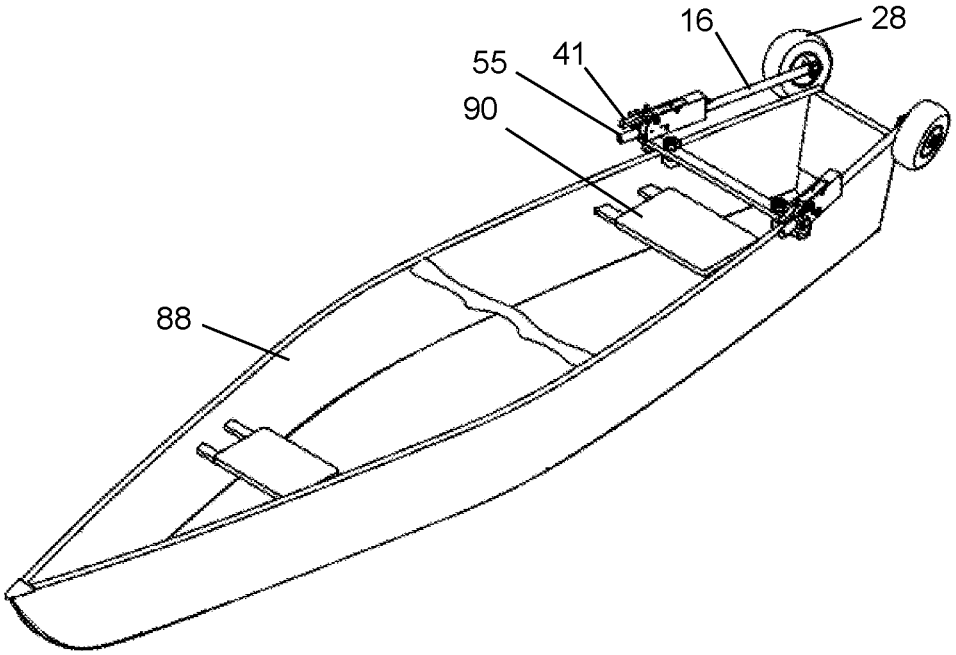
FIG. 6A is a perspective view of the wheel assembly embodiment of FIG. 1 installed on a watercraft in a retracted position.

The adaptable wheel assembly can be modified to fit the needs of a particular watercraft. This is accomplished by first determining the needed clearance between the hull of watercraft and the ground during transport on land. This distance would be used to calculate the needed length of the leg 30. In addition, if the user wishes to have the leg 30 flush with the gunwale 86 while in the retracted position, then the angle $\alpha$ as seen in FIG. 6C would need to be determined. This would determine the angle of the cross member mounting hole 77 centers wherein FIG. 5A is a useful reference. Finally, the spacing of the positioning brackets on cross member would be a function of the width of the hull at the installation location along with an offset to ensure the leg 30 clears each side of the watercraft. With these needed inputs, the manufacturer or user can adapt the adaptable wheel assembly to suitably fit up with a particular watercraft.

Figure 6B:
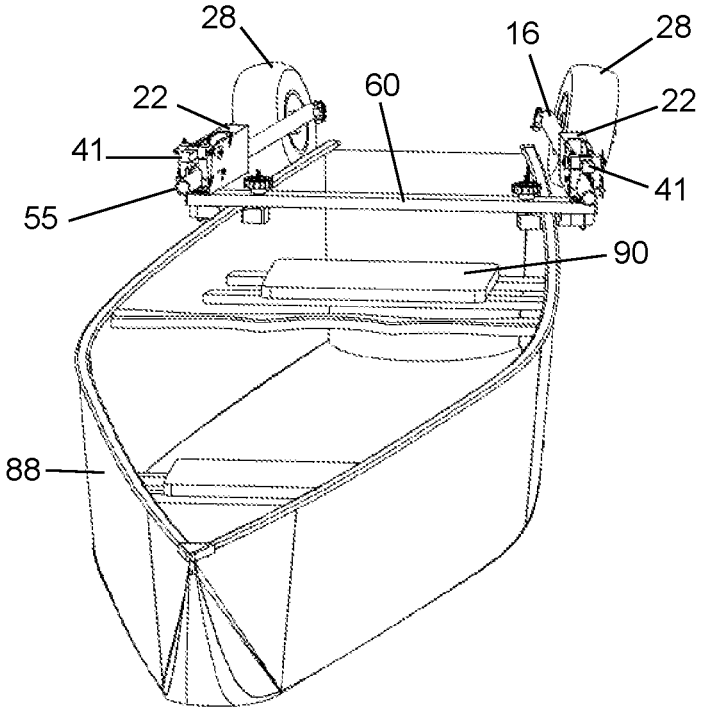
FIG. 6B is a front perspective view of the wheel assembly embodiment of FIG. 1 installed on a watercraft in a retracted position.
Figure 6C:
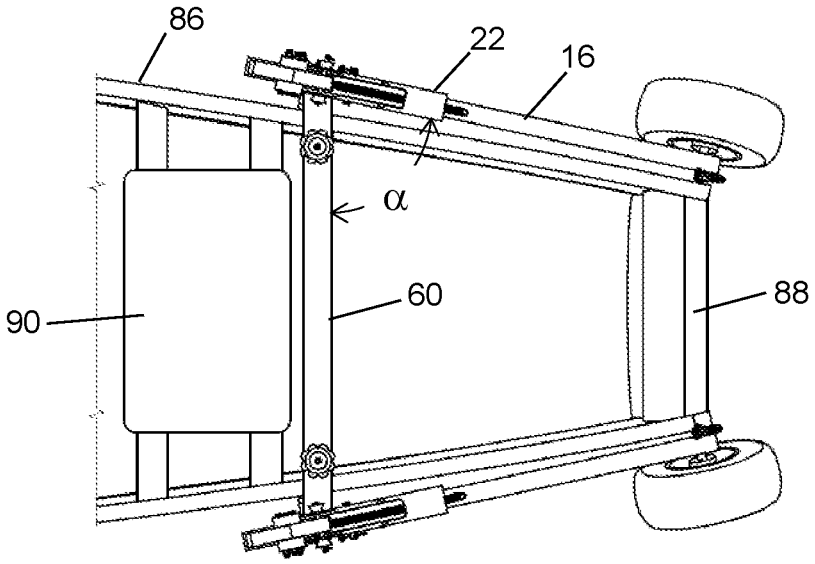
FIG. 6C is a plan view of the wheel assembly embodiment of FIG. 1 installed on a watercraft in a retracted position. Partial view of watercraft used to enhance features of installation.

Referring now to FIGS. 1, 5A, 6B, and 6C, the initial measurements required for manufacture of an adaptable leg assembly to a particular watercraft will be further explained. The representative watercraft 88 in FIGS. 6B and 6C is a type of canoe. The user would position a facsimile of the cross member 60 such as a yardstick used further in this discussion across the gunwales 86 of the watercraft 88, situating said yardstick on a top surface of said watercraft and perpendicular to a longitudinal axis of the watercraft running from bow to stern. The user would then maintain the perpendicular orientation of the yardstick and slide it until it is a comfortable distance behind the operator seat 90. At this location, the user would measure the angle created between the yardstick and the gunwale 86, and then use that as a reference to determine the desired angle $\alpha$ between the cross member 60 and each positioning bracket 22. The user would also measure the width required of cross member 60 so that the wheeled leg assembly clears all outer structure of the hull of said watercraft.

FIGS. 6 and 6A introduce a view of the embodiment of FIG. 1 after the adaptable landing gear has been fit up to a particular watercraft. In this example, the watercraft is a canoe with a square back for receiving a small outboard or trolling motor.

Referring now to FIGS. 5A, 6B, and 6C, mounting a fixed mount assembly 85 manufactured to fit a particular watercraft 88 will be explained. The cross member 60 is positioned as illustrated in FIGS. 6B and 6C such that it is both perpendicular to the longitudinal axis of the watercraft and situated such that an offset spacer 75 on each side is lightly touching an outer hull surface of watercraft 88. Next, mounting bolt 72 is inserted through gunwale clamp 64 and then through mounting hole 67. Hand wheel 62 is tightened onto mounting bolt 72 such that a portion of gunwale 86 is sandwiched between the cross member 60 and the gunwale clamp 64. The process would be repeated until all gunwale clamps are securely tightened. Side to side motion is further restricted by offset spacer 75. Positioning bracket 22 should be manufactured with materials of sufficient strength to enable additional brackets to be installed on each rearward inner vertical face of positioning bracket 22 to then attach to the gunnel or top surface of said watercraft if such attachment is deemed necessary by the user.

The structural elements of adaptable wheel assembly 10 that bear the weight of a watercraft, and its associated gear, should be of sufficient strength to support both aforementioned weight as well as the forces exerted on the wheeled leg assembly 16 by irregularities on the ground such as a rock, a boat ramp, submerged objects near the shore and the like. At the same time, users of small watercraft such as kayaks and canoes want their accessories to be both lightweight and resistant to corrosion from environmental factors such as rain and salt spray. The applicant has found that extruded aluminum tubes made from 6061 alloys made into various cross-sectional geometries are good candidates for weight bearing members such as the leg 30, the positioning bracket 22 and the cross member 60.

The means of attaching the fixed mount assembly 85 to a watercraft may vary from one watercraft to another and various hardware can be used. For instance, the cross member 60 may be attached to a T-track system pre-installed on a kayak by use of t-bolts, as is commonly used by those skilled in the art of customizing small watercraft. In this instance, the hand wheel 62, mounting bolts 72, and gunwale clamps 64 may be replaced by a T-bolt and associated washer and nut. The offset space 75 may or may not be necessary in this instance. The function of the wheeled leg assembly 16 and positioning brackets 22 remains similar in installation to either a canoe or kayak and falls within the scope of this disclosure and associated claims.

FIGS. 6B and 6C illustrate one embodiment of the adaptable wheel assembly 10 mounted on a watercraft 88 in a retracted position. The entire wheeled leg assembly 16 on each side of said watercraft will remain in the retracted position unless and until the operator presses down on the release lever 41. Once said release lever is sufficiently depressed, the center of mass of said wheel assembly is behind the wheeled assembly pivot pin 23, causing the assembly to rotate such that the wheels naturally fall to a near vertical position due to gravitational force. Gently pulling on the handle end 55 of the wheeled leg assembly 16 causes the locking pin assembly to snap into the rearward retaining slot 83 of the assembly bracket 22 thereby securing said wheel assembly in a substantially vertical or deployed position. The operator is free to move either wheeled leg assembly 16 between a retracted or deployed position while comfortably seated at the operator seat 90 without undue bodily twisting or manipulation of small mechanical screws, pins, and the like. All mechanical parts of the adaptable wheel assembly remain mechanically interconnected during use which is another distinct advantage of the embodiment of the invention. Wheels, legs, and any associated small hardware should not fall inadvertently fall into the body of water as may be the case with other systems distinct from this disclosure.

Numerous characteristics and advantages of have been set forth in the foregoing description, together with the details of structure and function. Many of the novel features are pointed out in the appended claims. The disclosure, however, is illustrative only, and changes may be made in detail, especially in matters of size, shape, and arrangement of parts, indicated by the broad general meaning of the terms in which the general claims are expressed. It is noted that the term pin is used in the generic sense, and any hardware useful for the purpose of functioning as a pin may be substituted. It is further noted that, as used in this application, the singular forms "a", "an", and "the" include plural referents unless expressly and unequivocally limited to one referent.

The invention claimed is:

1. A retractable wheel assembly adapted to support and transport a watercraft, said assembly comprising:

a cross member;

a first bracket attached to the cross member;

a first leg member pivotably attached to the first bracket in a transverse orientation to the cross member, and having distal and proximal ends;

a wheel mounted to the distal end of the first leg member; and a first position holding unit configured to secure the first leg member in a plurality of angular positions relative to the cross member, wherein:

the first position holding unit comprises:

a first retaining slot in the first bracket; and a holding pin attached to the first leg member;

the first leg member is secured in a first angular position relative to the cross member when the holding pin is received in the first retaining slot;

the first position holding unit includes a second retaining slot in the first bracket; and the first leg member is secured in a second angular position relative to the cross member when the holding pin is received in the second retaining slot.

2. The retractable wheel assembly according to claim 1, wherein the first position holding unit includes a pin moving mechanism configured to move the holding pin between a first pin position and a second pin position relative to the first leg member.

3. The retractable wheel assembly according to claim 2, wherein:

the pin moving mechanism comprises a release lever pivotably attached to the proximal end of the first leg member;

the holding pin is attached to the release lever; and the release lever is configured to pivot relative to the first leg member between a first position, which positions the holding pin in the first pin position, and a second position, which positions the holding pin in the second pin position.

4. The retractable wheel assembly according to claim 3, wherein the pin moving mechanism comprises a spring that biases the release lever in the first position and the holding pin in the first pin position.

5. The retractable wheel assembly according to claim 1, further comprising a pair of gunwale connectors, each attached to an end of the cross member and configured to secure the cross member to a gunwale of a watercraft.

6. The retractable wheel assembly according to claim 2, wherein:

the first bracket includes a pair of sidewalls;

the proximal end of the first leg member is positioned between the pair of sidewalls;

the first retaining slot comprises a first notch in each of the sidewalls of the first bracket;

the second retaining slot comprises a second notch in each of the sidewalls of the first bracket;

the holding pin is received within the first notches to secure the first leg member in the first angular position; and the holding pin is received within the second notches to secure the first leg member in the second angular position.

7. The retractable wheel assembly according to claim 1, wherein:

the first bracket and the first leg member are attached to a first end of the cross member;

the retractable wheel assembly comprising:

a second bracket attached to a second end of the cross member;

a second leg member pivotably attached to the second bracket in a transverse orientation to the cross member, and having distal and proximal ends;

a wheel mounted to the distal end of the second leg member; and a second position holding unit configured to secure the second leg member in a plurality of angular positions relative to the cross member.

8. The retractable wheel assembly according to claim 7, wherein:

the second position holding unit comprises:

a first retaining slot in the second bracket; and a second holding pin attached to the second leg member; and the second leg member is secured in a first angular position relative to the cross member when the second holding pin is received in the first retaining slot of the second bracket.

9. The retractable wheel assembly according to claim 8, wherein:

the first position holding unit includes a second retaining slot in the first bracket;

the second position holding unit includes a second retaining slot in the second bracket;

the first leg member is secured in a second angular position relative to the cross member when the first holding pin is received in the second retaining slot of the first bracket; and the second leg member is secured in a second angular position relative to the cross member when the second holding pin is received in the second retaining slot of the second bracket.

10. The retractable wheel assembly according to claim 9, wherein:

the first position holding unit includes a first pin moving mechanism comprising a first release lever pivotably attached to the proximal end of the first leg member, wherein the first holding pin is attached to the first release lever, and the first release lever is configured to pivot relative to the first leg member between a first position, which positions the first holding pin in the first pin position, and a second position, which positions the first holding pin in the second pin position; and the second position holding unit includes a second pin moving mechanism comprising a second release lever pivotably attached to the proximal end of the second leg member, wherein the second holding pin is attached to the second release lever, and the second release lever is configured to pivot relative to the second leg member between a first position, which positions the second holding pin in the first pin position, and a second position, which positions the second holding pin in the second pin position.

11. The retractable wheel assembly according to claim 10, wherein:

the first pin moving mechanism comprises a spring that biases the first release lever in the first position and the first holding pin in the first pin position; and the second pin moving mechanism comprises a spring that biases the second release lever in the first pin position and the second holding pin in the first pin position.

12. The retractable wheel assembly according to claim 6, wherein the first and second leg members are non-perpendicular to the cross member when in their first angular positions.

13. A retractable wheel assembly adapted to support and transport a watercraft, said assembly comprising:

a cross member;

a first bracket attached to a first end of the cross member;

a second bracket attached to a second end of the cross member;

a first leg member pivotably attached to the first bracket in a transverse orientation to the cross member, and having distal and proximal ends;

a second leg member pivotably attached to the second bracket in a transverse orientation to the cross member, and having distal and proximal ends;

a wheel mounted to the distal end of the first leg member;

a wheel mounted to the distal end of the second leg member;

a first position holding unit configured to secure the first leg member in a plurality of angular positions relative to the cross member; and a second position holding unit configured to secure the second leg member in a plurality of angular positions relative to the cross member, wherein:

the first position holding unit comprises:

a first retaining slot in the first bracket; and a first holding pin attached to the first leg member;

the second position holding unit comprises:

a first retaining slot in the second bracket; and a second holding pin attached to the second leg member;

the first leg member is secured in a first angular position relative to the cross member when the first holding pin is received in the first retaining slot of the first bracket; and the second leg member is secured in a first angular position relative to the cross member when the second holding pin is received in the first retaining slot of the second bracket.

14. The retractable wheel assembly according to claim 13, wherein:

the first position holding unit includes a second retaining slot in the first bracket;

the second position holding unit includes a second retaining slot in the second bracket;

the first leg member is secured in a second angular position relative to the cross member when the first holding pin is received in the second retaining slot of the first bracket; and the second leg member is secured in a second angular position relative to the cross member when the second holding pin is received in the second retaining slot of the second bracket.

15. The retractable wheel assembly according to claim 14, wherein:

the first position holding unit includes a first pin moving mechanism for moving the first holding pin between first and second pin positions relative to the first leg member; and the second position holding unit includes a second pin moving mechanism for moving the second holding pin between first and second pin positions relative to the second leg member.

16. The retractable wheel assembly according to claim 15, wherein:

the first position holding unit includes a first pin moving mechanism comprising a first release lever pivotably attached to the proximal end of the first leg member, wherein the first holding pin is attached to the first release lever, and the first release lever is configured to pivot relative to the first leg member between a first position, which positions the first holding pin in the first pin position, and a second position, which positions the first holding pin in the second pin position; and the second position holding unit includes a second pin moving mechanism comprising a second release lever pivotably attached to the proximal end of the second leg member, wherein the second holding pin is attached to the second release lever, and the second release lever is configured to pivot relative to the second leg member between a first position, which positions the second holding pin in the first pin position, and a second position, which positions the second holding pin in the second pin position.

17. The retractable wheel assembly according to claim 16, wherein:

the first pin moving mechanism comprises a spring that biases the first release lever in the first position and the first holding pin in the first pin position; and the second pin moving mechanism comprises a spring that biases the second release lever in the first pin position and the second holding pin in the first pin position.

18. The retractable wheel assembly according to claim 13, further comprising:

a first gunwale connector attached to the first end of the cross member; and a second gunwale connector attached to the second end of the cross member, wherein the first and second gunwale connectors are each configured to secure the cross member to a gunwale of a watercraft.

19. The retractable wheel assembly according to claim 13, wherein the first and second leg members are non-perpendicular to the cross member when in their first angular positions.

20. An assembly comprising:

a watercraft comprising a hull and a gunwale extending along a top of the hull; and a retractable wheel assembly comprising:

a cross member connected to the gunwale;

a first bracket attached to a first end of the cross member;

a first leg member pivotably attached to the first bracket in a transverse orientation to the cross member, and having distal and proximal ends;

a wheel mounted to the distal end of the first leg member; and a first position holding unit configured to secure the first leg member in a plurality of angular positions relative to the cross member and the gunwale, wherein:

a second bracket attached to a second end of the cross member;

a second leg member pivotably attached to the second bracket in a transverse orientation to the cross member, and having distal and proximal ends;

a wheel mounted to the distal end of the second leg member;

a second position holding unit configured to secure the second leg member in a plurality of angular positions relative to the cross member and the gunwale;

the first position holding unit comprises:

a first retaining slot in the first bracket; and a first holding pin attached to the first leg member;

the second position holding unit comprises:

a first retaining slot in the second bracket; and a second holding pin attached to the second leg member;

the first leg member is secured in a first angular position relative to the cross member and the gunwale when the first holding pin is received in the first retaining slot of the first bracket; and the second leg member is secured in a first angular position relative to the cross member and the gunwale when the second holding pin is received in the first retaining slot of the second bracket.

21. The assembly according to claim 20, wherein:

the first position holding unit includes a second retaining slot in the first bracket;

the second position holding unit includes a second retaining slot in the second bracket;

the first leg member is secured in a second angular position relative to the cross member and the gunwale when the first holding pin is received in the second retaining slot of the first bracket; and the second leg member is secured in a second angular position relative to the cross member and the gunwale when the second holding pin is received in the second retaining slot of the second bracket.

22. The assembly according to claim 21, wherein:

the first angular positions of the first and second leg members orient each of the first and second leg members in a horizontal orientation alongside the gunwale; and the second angular positions of the first and second leg members orient each of the first and second leg members in a vertical orientation that is transverse to the gunwale.

23. The assembly according to claim 22, wherein the first and second leg members are non-perpendicular to the cross member when in their first angular positions.

* * * * *